US008943619B2

(12) United States Patent
Romero

(10) Patent No.: US 8,943,619 B2
(45) Date of Patent: Feb. 3, 2015

(54) TRAP ASSEMBLY FOR A HYBRID WALL URINAL AND ASSOCIATED METHODS

(76) Inventor: Jose Romero, Orlando, FL (US)

( * ) Notice: Subject to any disclaimer, the term of this patent is extended or adjusted under 35 U.S.C. 154(b) by 416 days.

(21) Appl. No.: 13/525,571

(22) Filed: Jun. 18, 2012

(65) Prior Publication Data

US 2012/0317707 A1 Dec. 20, 2012

Related U.S. Application Data

(60) Provisional application No. 61/498,234, filed on Jun. 17, 2011.

(51) Int. Cl.
*E03D 13/00* (2006.01)
*E03C 1/29* (2006.01)

(52) U.S. Cl.
CPC .. *E03C 1/29* (2013.01); *E03D 13/00* (2013.01)
USPC ..... 4/301; 4/144.1; 4/679

(58) Field of Classification Search
USPC ..... 4/301, 144.1, 679
See application file for complete search history.

(56) References Cited

U.S. PATENT DOCUMENTS

| | | | | |
|---|---|---|---|---|
| 5,711,037 | A | 1/1998 | Reichardt et al. | |
| 6,286,153 | B1 * | 9/2001 | Keller | 4/301 |
| 6,425,411 | B1 * | 7/2002 | Gorges | 4/144.1 |
| 7,111,332 | B1 | 9/2006 | Hsia | |
| 7,246,386 | B2 | 7/2007 | Hall | |
| 7,636,957 | B2 | 12/2009 | Funari | |

* cited by examiner

*Primary Examiner* — Tuan N Nguyen
(74) *Attorney, Agent, or Firm* — Allen, Dyer, Doppelt, Milbrath & Gilchrist, P.A.

(57) ABSTRACT

A trap for positioning within a wall urinal includes a housing having an open top end and an open bottom end coupled to a drainage pipe. The trap includes a top that includes an upper surface with a center portion having at least one drainage opening extending therethrough. The top is to be coupled to the open top end of the housing. A drainage tube has an open top end and an open bottom end, with the open top end coupled to the center portion of the top and aligned with the at least one drainage opening. A cup is to be suspended within the housing and has an open top end and a closed bottom end with sidewalls therebetween, and with the open bottom end of the drainage tube inserted into the cup.

23 Claims, 7 Drawing Sheets

TRAP ASSEMBLY FOR A HYBRID WALL URINAL AND ASSOCIATED METHODS

RELATED APPLICATIONS

This application claims the benefit of U.S. Provisional Application Ser. No. 61/498,234 filed Jun. 17, 2011, the entire contents of which are incorporated herein by reference.

FIELD OF THE INVENTION

The present invention relates to the field of urinals, and more particularly, to a trap for a wall urinal.

BACKGROUND OF THE INVENTION

Global demand on clean potable water continues to grow. Already strained water resources continue to fall in volume and quality. Additionally, waste water systems are finding difficulties with additional capacity due to population growth. As water conservation continues to increase in importance globally, waterless urinals will play an increasingly important role in conservation efforts.

Plumbing and sanitation codes require urinals to provide a liquid seal to prevent sewer gases from escaping. This has been achieved for many years by the use of conventional traps called p-traps, s-traps or bell traps. These typically form a seal by allowing residual flushing water to remain in sufficient quantity to provide the required barrier. This seal provides an effective method of blocking odors from entering the restroom environment. However, flushing systems allow residual urine to sometimes remain in the trap and not completely evacuate the trap of the urine. This causes the residual urine to break down and release ammonia dioxide in sufficient amounts to cause odors in the restroom. The upward facing surface of the trap communicates freely with the open environment causing odors. This is usually remedied by flushing the urinal multiple times to reduce the odors. This is a waste of clean fresh water.

Waterless urinals have now been widely accepted in the U.S. and across the world. Many of these use a trap covered with a lighter than water liquid, typically an oil based product. These typically use either a cartridge trap as disclosed in U.S. Pat. No. 5,711,037, a divided portion bell trap as disclosed in U.S. Pat. No. 7,636,957 or p-traps filled with oil. There is also a waterless self-flushing urinal that recycles and separates as disclosed in U.S. Pat. No. 7,111,332. Additionally, U.S. Pat. No. 7,246,386 discloses a waste outlet assembly using an elongated cylindrical insert with the lower end which ends in a reservoir of urine, which is the trap. The cylindrical insert sits slightly inside the waste trap.

The above mentioned traps are directly connected to the drain system, and are large in volume. These traps may also have removable bottom portion. There are also waterless urinals that are designed with one-way valves that allow urine to flow through while preventing sewer gases from coming back up through the valve.

The current waterless urinal systems, regardless of the different types, have deficiencies in terms of ongoing maintenance requirements, replacement of trap sealing media and drain line sediment buildup.

SUMMARY OF THE INVENTION

In view of the foregoing, an object of the present invention is to provide a straightforward trap assembly for wall urinals.

This and other objects, advantages and features are provided by a trap for positioning within a wall urinal comprising a housing having an open top end and an open bottom end coupled to a drainage pipe. The trap may comprise a top comprising an upper surface with a center portion having at least one drainage opening extending therethrough. The top may be coupled to the open top end of the housing. A drainage tube may have an open top end and an open bottom end, with the open top end coupled to the center portion of the top and aligned with the at least one drainage opening. A cup may be suspended within the housing and have an open top end and a closed bottom end with sidewalls therebetween, and with the open bottom end of the drainage tube inserted into the cup.

The cup may comprise a plurality of spaced apart ribs extending outwards from the sidewalls and contacting sidewalls of the housing.

The top may comprise a center mast extending outwards from the upper surface. The trap may further comprise an enclosure coupled to the center mast, and has a hollow interior for holding a gel material that reacts with urine received by said top.

The enclosure may comprise a bottom having a plurality of openings extending therethrough to expose the gel material to the urine, and a dome-shaped surface may be coupled to the bottom. The bottom may comprise a center hub extending outwards therefrom for receiving the center mast, with the bottom being spaced away from the upper surface of the top. The dome-shaped surface may comprise a notched edge extending past the bottom for contacting the upper surface of the top.

The trap may further comprise a removal tool comprising a shaft having a top end and a bottom end, and a pair of curved arms extending outwards from the bottom end of the shaft, with each arm comprising a lip for extending between notches of the notched edge of the dome-shaped cover. The top may comprise a center mast extending outwards from the upper surface, and wherein the top end of the shaft has an opening for engaging the center mast.

Another aspect is directed to a trap assembly comprising the housing and the trap received by the housing.

Yet another aspect is directed to a method for making a trap as described above.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer like elements throughout and prime notations are used to indicate similar elements in alternative embodiments.

Figure 1:
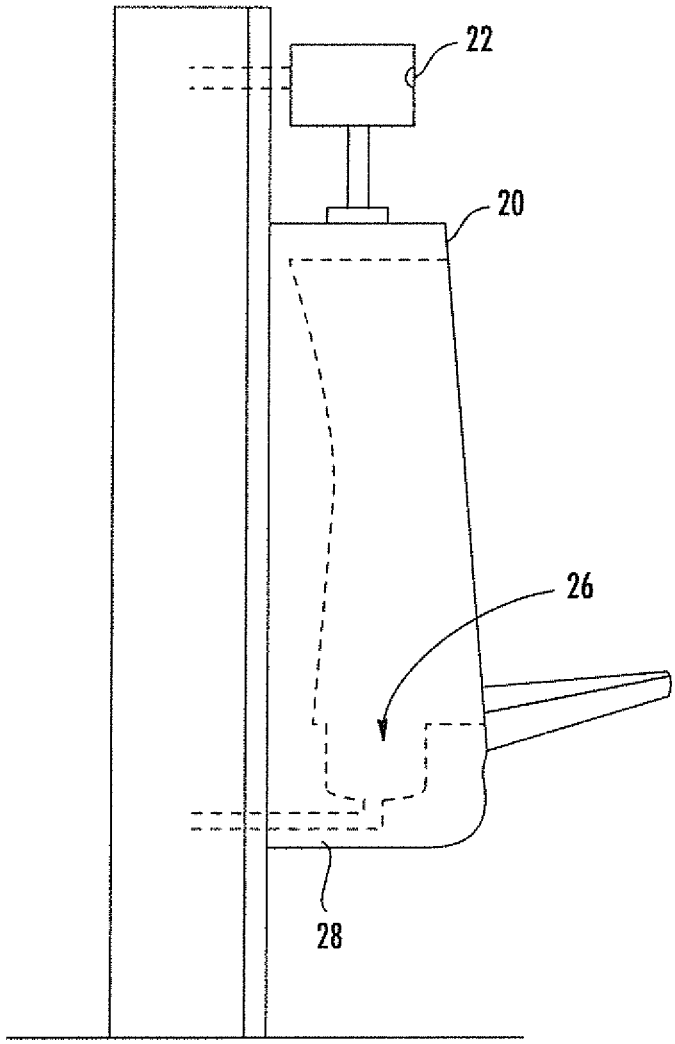
FIG. 1 illustrates a side perspective view of a wall urinal in accordance with the present invention.
Figure 2:
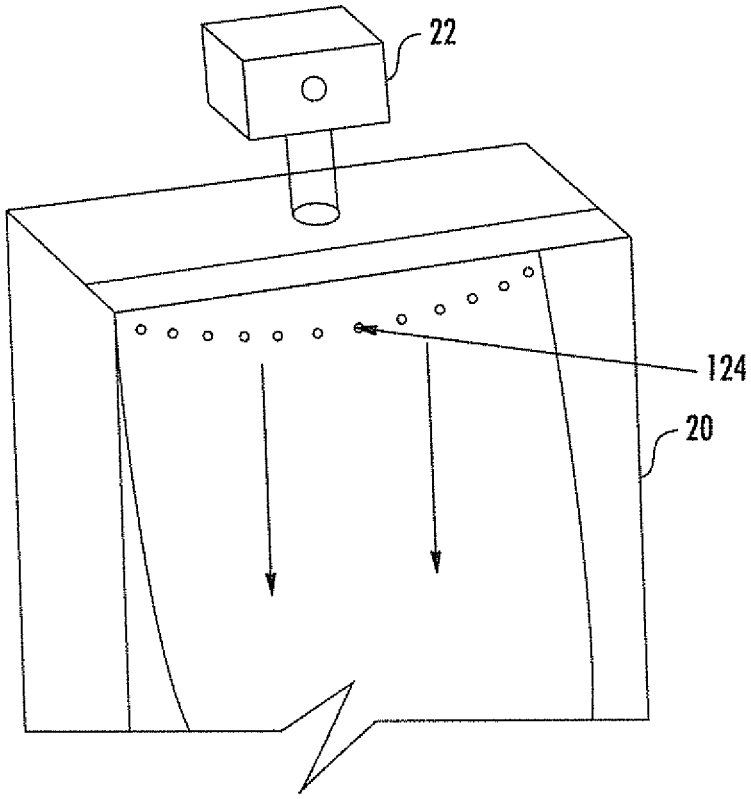
FIG. 2 illustrates a partial front perspective view of the wall urinal shown in FIG. 1.
Figure 3:
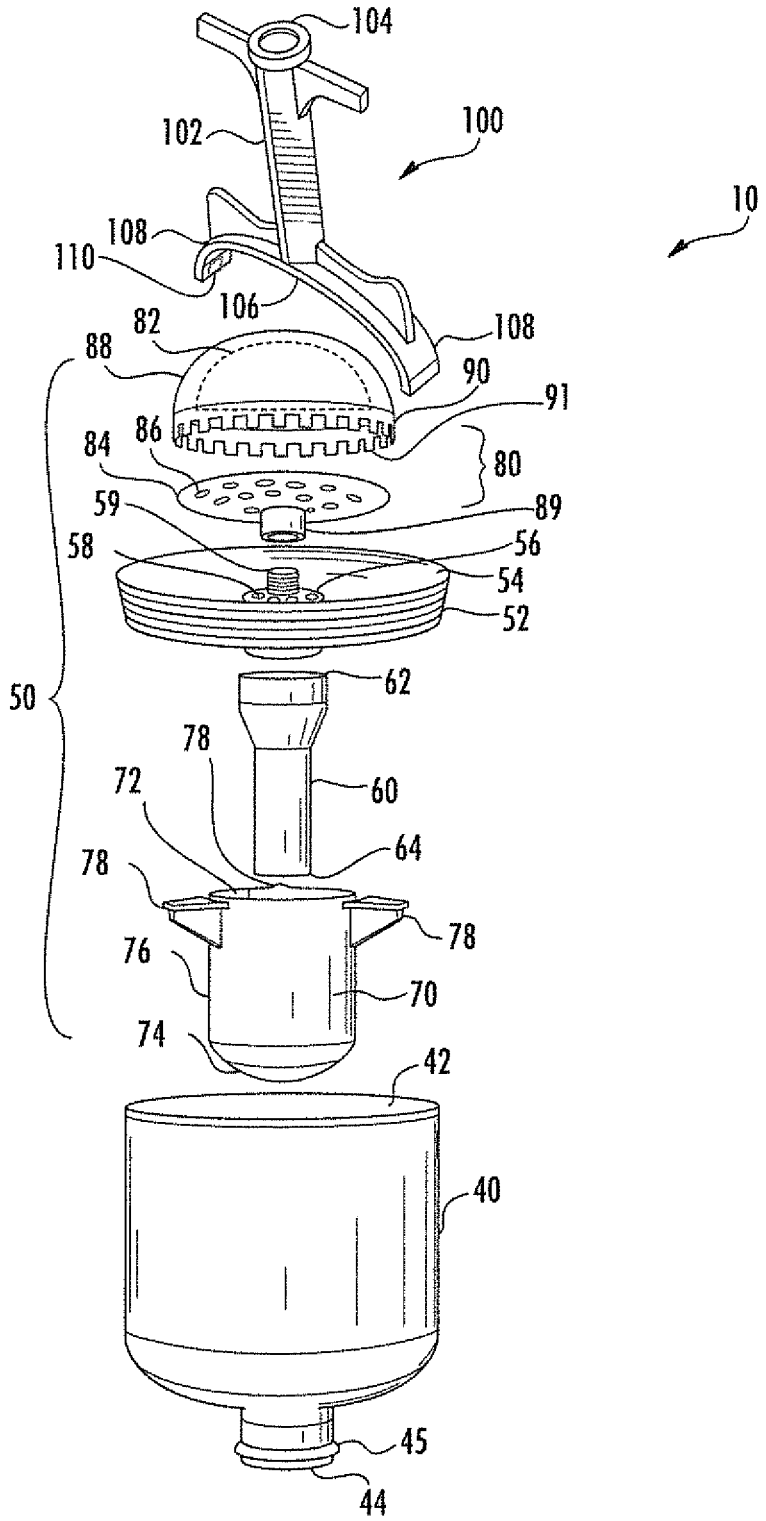
FIG. 3 is an exploded view of a trap assembly to be received by the wall urinal shown in FIG. 1.

Referring initially to FIGS. 1-3, a trap assembly 10 for a wall urinal 20 will now be discussed. The wall urinal 20 may be configured as a hybrid wall urinal, which means that it may be designed to operate as a waterless urinal, a water urinal, or both.

A flush valve assembly 22 is located at the top of the wall urinal 20, as shown in FIGS. 1 and 2. When the flush valve assembly 22 is activated, water flows out of a plurality of openings 24. For a waterless urinal, the flush valve assembly 22 would not be installed.

The illustrated wall urinal 20 is much like a standard urinal bowl except for the bottom. The bottom of the bowl has an opening 26 for receiving the trap assembly 10, where an exploded view is provided in FIG. 3. As will be described in greater detail below, the trap assembly 10 functions optimally with or without water.

The trap assembly 10 includes a housing 40 and a trap 50 that is received by the housing. The housing 40 is to be positioned within the opening 26 of the wall urinal 20. The housing 40 has an open top end 42 and an open bottom end 44 to be coupled to a drainage pipe 28.

The trap 50 includes a top 52 that has an upper surface 54 with a center portion 56 having at least one drainage opening 58 extending therethrough. The top 52 is coupled to the open top end 42 of the housing 40. A drainage tube 60 has an open top end 62 and an open bottom end 64. The open top end 62 is coupled to the center portion 56 of the top 52 and is aligned with the at least one drainage opening 58. A cup 70 is suspended within the housing 40 and has an open top end 72 and a closed bottom end 74 with sidewalls 76 therebetween. The open bottom end 64 of the drainage tube 60 is inserted into the cup 70.

The cup 70 includes a plurality of spaced apart ribs 78 extending outwards from the sidewalls 76 thereof and contacts the housing 40. The spacing between the sidewalls 76 of the cup and interior sidewalls of the housing define an overflow drainage, the contents of which are received by the drainage pipe 28.

The top 52 includes a center mast 59 extending outwards from the center portion 56. An enclosure 80 is coupled to the center mast 59, and has a hollow interior for holding a gel material 82 that reacts with urine received by the top 52. The enclosure includes a bottom 84 having a plurality of openings 86 extending therethrough to expose the gel material to the urine. A dome-shaped surface 88 forming the hollow interior is coupled to the bottom 84.

The bottom 84 includes a center hub 89 extending outwards therefrom for receiving the center mast 59. The interface between the center mast 59 and the hub 89 may be threaded, for example. The bottom 84 is spaced from the upper surface 54 of the top 52. The dome-shaped surface 88 includes a corrugated or notched edge 90 extending past the bottom 84 for contacting the upper surface 54 of the top 52. The notched edge 90 includes a series of spaced apart notches 91 around the perimeter of the dome-shaped surface 88 to prevent debris from blocking the drainage openings 58 in the center portion 56 of the top 52.

A removal tool 100 may also be provided for removing the enclosure 80 when coupled to the center mast 59. The removal tool 100 may also be used for coupling the enclosure 80 to the center mast 59. Yet another use for the removal tool is to remove the trap 50 from the housing 40.

The removal tool 100 includes a shaft 102 having a top end 104 and a bottom end 106, and a pair of curved arms 108 extending outwards from the bottom end 106 of the shaft 102. Each arm includes a lip 110 for extending between adjacent notches 91 on the dome-shaped cover 88. This is useful for holding the enclosure 80 so that it may be secured to the center mast 59 by rotating in a clockwise direction, or removed from the center mast 59 by rotating in a counterclockwise direction when the interface between the center mast 59 and the center hub 89 is a threaded interface. Each arm 108 may also have a tab 109 extending therefrom so as to allow a user to pull on so as release the enclosure 80 (and the trap 50 if coupled to the enclosure) from the engaged lips 110.

In addition, the top end 104 of the shaft 102 has an opening for engaging the center mast 59. The interface between the center mast 59 and the top end 104 of the shaft 102 may also be a threaded interface. With the top end 104 of the shaft 102 secured to the center mast 59, the trap 50 may be removed from the housing 40, as well as inserted into the housing 40 as needed.

Figure 4:
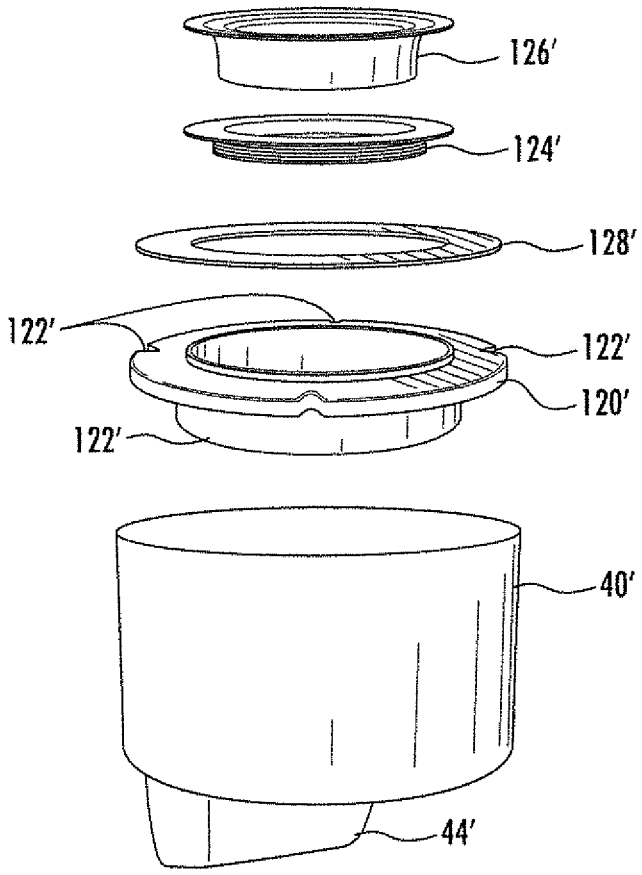
FIG. 4 is an exploded view of the housing and inserts associated therewith in accordance with the present invention.

The housing 40 may be configured with the open bottom end 44 extending outwards in a vertical direction, as shown in FIG. 3. Alternatively, the open bottom end 44' may extend in a horizontal direction, as shown in FIG. 4. Inserts associated with the housing 40' will now be discussed in reference to FIG. 4.

A plate 120' may be secured to the housing 44'. An outer edge of the plate 120' has a plurality of spaced apart recessed openings 122' configured to receive fasteners used to create a downward pressure on the housing 40'. This downward pressure effectively locks the housing 40' to the urinal 20 so that a secure connection may be made. One or more stainless steel rings 124', 126' may be inserted into an opening in the plate 120'. A gasket 128' may be positioned between the plate 120' and the stainless steel rings 124', 126'.

Figure 5:
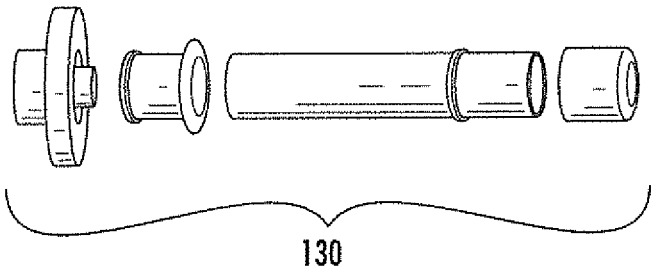
FIG. 5 is an exploded view of adapter and couples used to interface between the housing shown in FIG. 4 and a drainage pipe.

Adapters and couplers, collectively indicated by reference 130, may be used to interface between the open bottom end 44' of the housing 40' to the drainage pipe 28, as shown in FIG. 5.

Figure 6:
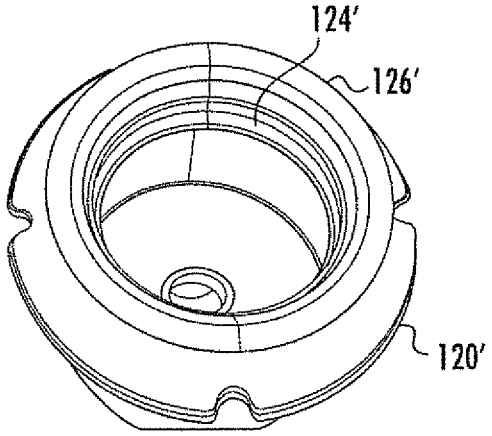
FIG. 6 is a top perspective view of the housing shown in FIG. 4 with the inserts positioned therein.
Figure 7:
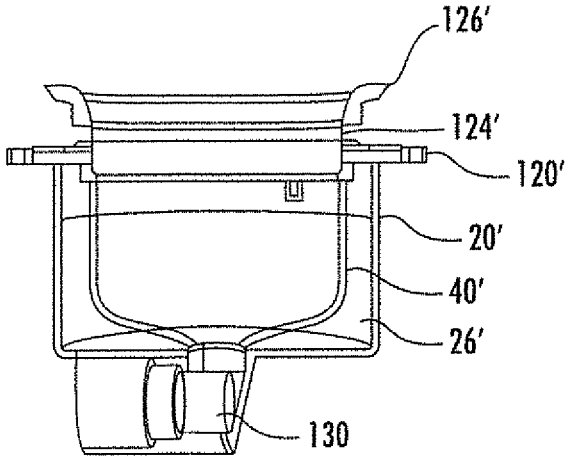
FIG. 7 is a side cut-away view of the housing shown in FIG. 4 with the inserts positioned therein.
Figure 8:
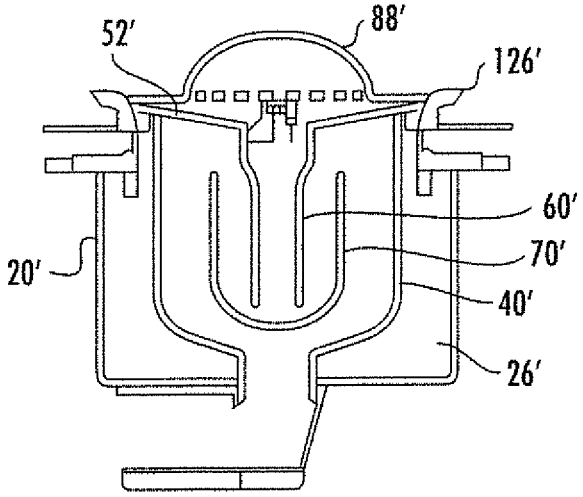
FIG. 8 is a side cut-away view of the housing shown in FIG. 4 with both the inserts and trap positioned therein.

A top perspective view of the housing 40' with the inserts 120', 124' and 126' positioned therein is shown in FIG. 6. A side cut-away view of the housing 40' positioned within an opening 26' of a wall urinal 20' is shown in FIG. 7. The illustrated housing 40' also includes the inserts 120', 124' and 126' positioned therein. Similarly, a side cut-away view of the housing 40' and trap 50 positioned within an opening 26' of a wall urinal 20' is shown in FIG. 8. The illustrated housing 40' and trap 50' also includes the inserts 120', 124' and 126' positioned therein.

Figure 9:
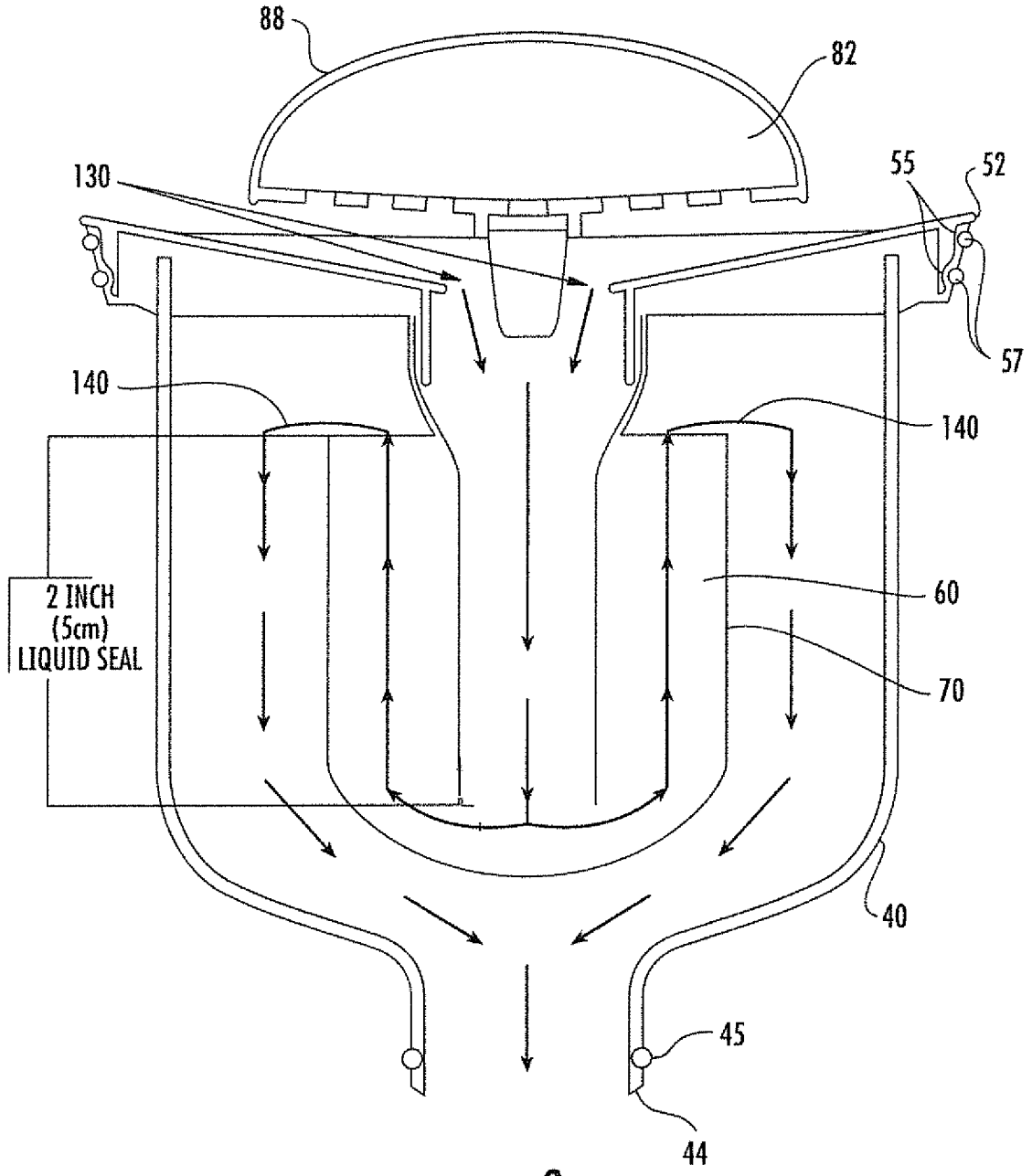
FIG. 9 is a cut-away side view of the trap assembly showing liquid flow and liquid levels in accordance with the present invention.
Figure 10:
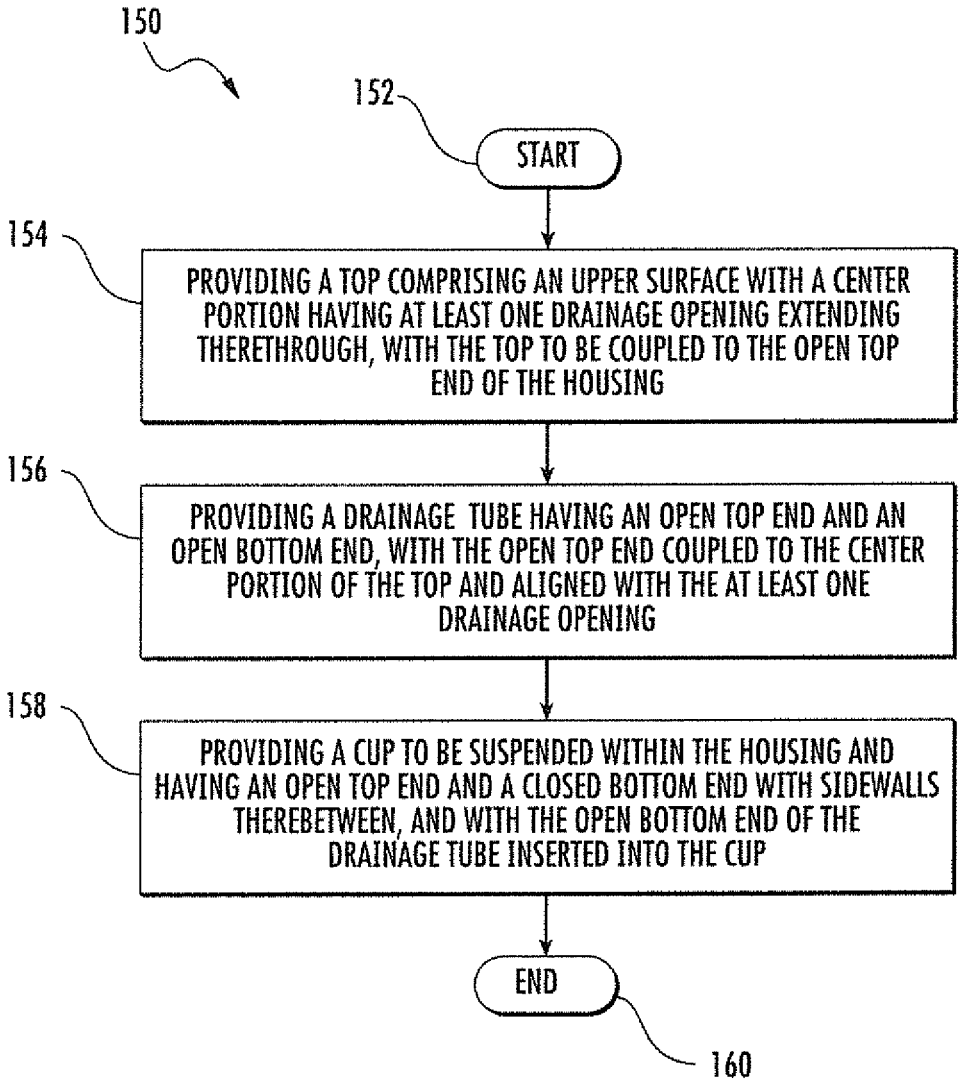
FIG. 10 is a flowchart illustrating a method for making a trap in accordance with the present invention.

Referring now to FIG. 9 and back to FIG. 3, specifics of the trap assembly 10 including operation thereof will now be discussed in greater detail. The center mast 59 of the top 52 is about 1 cm in length and the drainage openings 58 in the center portion 89 of the top 52 allows for drainage into the tube 60. The tube 60 is cylindrical in shape with a wide top that may be glued to a bottom surface of the top 52. The tube 60 is inserted inside the cup about ¾ of the way inside.

The illustrated cup 70 has 3 ribs 78 which attach to the housing 40 with locking clips having a u-shaped opening to receiving outer edges of a respective rib 78. The ribs 78 may be glued within the locking clips. The housing 40 may be joined to the top 52 utilizing 3 locking clips. These locking clips may also be glued around the outer circumference on the outside of the housing 40 where joined with the top 52.

The housing 40 has an open bottom end 42 defining a drain area with a tubular drain assembly 130 that may be coupled thereto. An o-ring 45 is positioned on the open bottom end of the housing 40 to create a sealed connection with the tubular drain assembly 130.

In addition, the top 52 has two groves 55 to accommodate two sealing rubber gaskets 57. The sealing rubber gaskets 57 provide a tight seal against the stainless steel retainer ring 126' shown in FIG. 4 that is attached to be attached to the housing 40.

The trap 50 allows urine to flow through the top 52, as indicated by arrows 130, with the urine creating a liquid seal. The trap 50 is design so that the urine itself provides a necessary liquid seal to maintain proper protection against sewer gases. The tube 60 may have an internal diameter of 17 mm, for example, to create a very small surface area which limits exposure to potential urine odor. This is due not only to the diameter of the tube 60 exposed but also to the liquid amount in total within the cup 70. In total volume the trap holds about 4 liquid ounces.

The average male urinates about 12 liquid ounces. This amount is more than sufficient to completely change the contents of the cup 70, as indicated by arrows 140 representing the flow of urine through the tube 60 and through the cup 70. As urine exits the body it has a ph between 6.5 to 7.2 normally. When the urine enters the trap assembly 10 it will by gravity and design, so that the urine concentrates around the center mast 59 of the top 52.

The center mast 59 is attached directly above to the enclosure 80, which is gel 82 filled. The enclosure 80 has an exposed bottom 84. The exposed bottom 84 will come in contact with the urine. The gel 82 has Ph lowering capabilities as it is made with citric acid having a ph of 4. The gel 82 also has enzymatic material designed to digest urea sediment. In addition, the gel 82 has fragrance to reduce foul odors. The combination of the size of the tube 60, which defines a surface area exposure size of the urine, the reduced overall cup 70 size, which provides about a 2 inch liquid seal, and the enclosure 80 advantageously offer protection against foul odors.

More generally, the trap assembly 10 allows the customer to choose how to operate and maintain their wall urinal 20. A hybrid urinal 20 thus allows the customer to customize whether the urinal will operate as a waterless urinal, a water urinal, or both.

The trap assembly 10 accepts traditional flush valve assemblies with manual or automatic actuation. The flush valve (if desired) can be manual. However, manual valves will have push button manual flushing mechanism installed on the back while not allowing the user to flush. Only the maintenance personnel should have knowledge to flush the system when it is deemed necessary. This will allow easy access for maintenance personnel to a water source and which will facilitate the periodic flushing of the system. This will have no negative effect on the trap 50 and will actually be recommended to keep drain lines free and clear of debris.

Another option is an electronic flush valve version. The electronic flush valve has a programmable circuit board that will electronically activate flushing action similarly to other electronic type valves. An optical infrared sensor device may be used to accurately measure and count users as they are in front of the wall urinal 20 at a minimum of 5 seconds, for example. This will not trigger automatically generate a flushing action since user may be counted. The circuit board will have programmable option action switches that will be controllable by the customer. This controllable feature will allow the installer to program the wall urinal 20 system to flush after every 25, 50, 75 or 100 users have visited the urinal, for example. This will automatically clean the trap 50 and flush enough water to clean the drain line to prevent any residual drain line clogging issues.

A variation of this technique is to offer a program sentinel flush. The sentinel flush is a program by which the flush valve will automatically flush a full 1.5 gallon flush every 24 hours. This will offer the same benefits as previously mentioned. Another option is to conventionally install either a manual or an automatic valve that will flush only 12 ounces of water per flush. This will completely evacuate the trap 50 of any residual urine. This option basically makes the system an ultra low flow water urinal.

The trap assembly 10 advantageously utilizes the trap 50 to optimally insure viability of waterless urinals while reducing maintenance and eliminating sediment buildup issues associated with other waterless urinal systems.

Referring now to the flowchart 150 in FIG. Another aspect is directed to a method for making a trap 50 for positioning within a wall urinal 20 comprising a housing 40 having an open top end 42 and an open bottom end 44 coupled to a drainage pipe 28. From the start (Block 152), the method comprises providing at Block 154 a top 52 comprising an upper surface 54 with a center portion 56 having at least one drainage opening 58 extending therethrough, with the top 52 to be coupled to the open top end 42 of the housing 40. A drainage tube 60 is provided at Block 156, where the drainage tube has having an open top end 62 and an open bottom end 64, with the open top end being coupled to the center portion 56 of the top 52 and aligned with the at least one drainage opening 58. A cup 70 is provided at Block 158 to be suspended within the housing 40 and has an open top end 72 and a closed bottom end 74 with sidewalls 76 therebetween, and with the open bottom end 64 of the drainage tube 60 inserted into the cup 70. The method ends at Block 160.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the disclosure.

That which is claimed is:

1. A trap for positioning within a wall urinal comprising a housing having an open top end and an open bottom end coupled to a drainage pipe, the trap comprising:

a top comprising an upper surface with a center portion having at least one drainage opening extending therethrough, said top to be coupled to the open top end of the housing;

a drainage tube having an open top end and an open bottom end, with the open top end coupled to the center portion of said top and aligned with the at least one drainage opening; and a cup to be suspended within the housing and having an open top end and a closed bottom end with sidewalls therebetween, and with the open bottom end of said drainage tube inserted into said cup.

2. The trap according to claim 1 wherein said cup comprises a plurality of spaced apart ribs extending outwards from said sidewalls and contacting sidewalls of the housing.

3. The trap according to claim 1 wherein said top comprises a center mast extending outwards from said upper surface; and further comprising an enclosure coupled to said center mast, and having a hollow interior for holding a gel material that reacts with urine received by said top.

4. The trap according to claim 3 wherein said enclosure comprises:

a bottom having a plurality of openings extending therethrough to expose the gel material to the urine; and a dome-shaped surface coupled to said bottom.

5. The trap according to claim 4 wherein said bottom comprises a center hub extending outwards therefrom for receiving said center mast, with said bottom being spaced away from the upper surface of said top.

6. The trap according to claim 4 wherein said dome-shaped surface comprises a notched edge extending past said bottom for contacting the upper surface of said top.

7. The trap according to claim 6 further comprising a removal tool comprising:

a shaft having a top end and a bottom end; and a pair of curved arms extending outwards from the bottom end of said shaft, with each arm comprising a lip for extending between notches of the notched edge of said dome-shaped cover.

8. The trap according to claim 7 wherein said top comprises a center mast extending outwards from said upper surface; and wherein the top end of said shaft has an opening for engaging said center mast.

9. A trap assembly comprising:

a housing to be positioned within an opening in a wall urinal, and having an open top end and an open bottom end to be coupled to a drainage pipe; and a trap comprising a top comprising an upper surface with a center portion having at least one drainage opening extending therethrough, said top to be coupled to the open top end of the housing, a drainage tube having an open top end and an open bottom end, with the open top end coupled to the center portion of said top and aligned with the at least one drainage opening, and a cup to be suspended within the housing and having an open top end and a closed bottom end with sidewalls therebetween, and with the open bottom end of said drainage tube inserted into said cup.

10. The trap assembly according to claim 9 wherein said cup comprises a plurality of spaced apart ribs extending outwards from said sidewalls and contacting sidewalls of the housing.

11. The trap assembly according to claim 9 wherein said top comprises a center mast extending outwards from said upper surface; and further comprising an enclosure coupled to said center mast, and having a hollow interior for holding a gel material that reacts with urine received by said top.

12. The trap assembly according to claim 11 wherein said enclosure comprises:

a bottom having a plurality of openings extending therethrough to expose the gel material to the urine; and a dome-shaped surface coupled to said bottom.

13. The trap assembly according to claim 12 wherein said bottom comprises a center hub extending outwards therefrom for receiving said center mast, with said bottom being spaced away from the upper surface of said top.

14. The trap assembly according to claim 12 wherein said dome-shaped surface comprises a notched edge extending past said bottom for contacting the upper surface of said top.

15. The trap assembly according to claim 14 further comprising a removal tool comprising:

a shaft having a top end and a bottom end; and a pair of curved arms extending outwards from the bottom end of said shaft, with each arm comprising a lip for extending between notches of the notched edge of said dome-shaped cover.

16. The trap assembly according to claim 7 wherein said top comprises a center mast extending outwards from said upper surface; and wherein the top end of said shaft has an opening for engaging said center mast.

17. A method for making a trap for positioning within a wall urinal comprising a housing having an open top end and an open bottom end coupled to a drainage pipe, the method comprising:

providing a top comprising an upper surface with a center portion having at least one drainage opening extending therethrough, with the top to be coupled to the open top end of the housing;

providing a drainage tube having an open top end and an open bottom end, with the open top end coupled to the center portion of the top and aligned with the at least one drainage opening; and providing a cup to be suspended within the housing and having an open top end and a closed bottom end with sidewalls therebetween, and with the open bottom end of the drainage tube inserted into the cup.

18. The method according to claim 17 wherein the cup comprises a plurality of spaced apart ribs extending outwards from the sidewalls and contacting sidewalls of the housing.

19. The method according to claim 17 wherein the top comprises a center mast extending outwards from the upper surface; and further comprising providing an enclosure coupled to the center mast, and having a hollow interior for holding a gel material that reacts with urine received by the top.

20. The method according to claim 19 wherein the enclosure comprises a bottom having a plurality of openings extending therethrough to expose the gel material to the urine; and a dome-shaped surface coupled to the bottom.

21. The method according to claim 20 wherein the bottom comprises a center hub extending outwards therefrom for receiving the center mast, with the bottom being spaced away from the upper surface of the top; and wherein the dome-shaped surface comprises a notched edge extending past the bottom for contacting the upper surface of the top.

22. The method according to claim 21 further comprising providing a removal tool comprising a shaft having a top end and a bottom end; and a pair of curved arms extending outwards from the bottom end of the shaft, with each arm comprising a lip for extending between notches of the dome-shaped cover.

23. The method according to claim 22 wherein the top comprises a center mast extending outwards from the upper surface; and wherein the top end of the shaft has an opening for engaging the center mast.

* * * * *